United States Patent [19]

Singhal

[11] Patent Number: 4,602,951

[45] Date of Patent: Jul. 29, 1986

[54] PRODUCTION OF IRON-BORON-SILICON COMPOSITION FOR AN AMORPHOUS ALLOY WITHOUT USING FERROBORON

[75] Inventor: Subhash C. Singhal, Murrysville Boro, Pa.

[73] Assignee: Westinghouse Electric Corp., Pittsburgh, Pa.

[21] Appl. No.: 775,075

[22] Filed: Sep. 12, 1985

[51] Int. Cl.[4] ..... C22C 33/00

[52] U.S. Cl. ..... 75/133; 75/129; 75/133.5

[58] Field of Search ..... 75/133, 133.5

[56] References Cited

U.S. PATENT DOCUMENTS

| | | | |
|---|---|---|---|
| 4,297,135 | 10/1981 | Giessen | 75/129 |
| 4,397,691 | 8/1983 | Hamada | 75/123 B |
| 4,440,568 | 4/1984 | Staggers | 75/129 |
| 4,509,976 | 4/1985 | Zambrano | 75/129 |
| 4,536,215 | 8/1985 | Coad | 75/129 |

*Primary Examiner*—Peter D. Rosenberg

*Attorney, Agent, or Firm*—R. D. Fuerle

[57] ABSTRACT

This is a process for producing an iron-boron-silicon-carbon composition for a magnetic amorphous alloy. This process utilizes the silicon reduction of $B_2O_3$ and avoids using expensive ferroboron as an ingredient. It also results in an alloy which is substantially free from aluminum impurity. The process uses a mixture of an iron containing constituent, a silicon containing constituent, a carbon-containing constituent and boric acid. Only 1–1.75 times the stoichiometric boron-containing amount of boric acid is required. The iron constituent is preferably selected from iron, iron oxide, ferrosilicon, carbon in iron and mixtures thereof. The silicon constituent is preferably selected from silicon, ferrosilicon, and mixtures thereof. The carbon constituent is preferably selected from the group consisting of carbon, carbon in iron and mixtures thereof. The reaction produces molten iron-3% boron-5% silicon alloy with up to 1% carbon. The reaction also produces a silicon dioxide containing slag.

9 Claims, No Drawings

PRODUCTION OF IRON-BORON-SILICON COMPOSITION FOR AN AMORPHOUS ALLOY WITHOUT USING FERROBORON

CROSS-REFERENCE TO RELATED APPLICATIONS

A method for producing such an alloy by means of a carbon reduction of boric acid is described in related application Ser. No. 06/775,205, filed Sept. 12, 1985 assigned to the same assignee. Although the end product is the same, the process of that related case uses carbon reduction, rather than silicon reduction as in the instant invention.

A method for making ferroboron is described in related application Ser. No. 06/775,074, filed Sept. 12, 1985 assigned to the same assignee. Like the instant invention, this related application uses silicon reduction of boric acid; however, the method of the related application makes ferroboron, rather than the final alloy.

BACKGROUND OF THE INVENTION

The present invention relates to a process for making amorphous alloys (either directly or by making master alloy for use in ultimately making amorphous alloy) such as are intended, for example, to at least partially replace crystalline electrical steels in transformers. In particular, this invention relates to a method for making such amorphous alloys which avoids the use of expensive ferroboron.

An amorphous alloy of iron-3% boron-5% silicon, typically containing about 0.5% carbon, has been suggested for a number of magnetic applications, such as in motors and transformers. This alloy has been relatively expensive, however, principally due to the cost of boron. The boron content typically has been added in the form of ferroboron which has been prepared by carbon reduction of a mixture of $B_2O_3$, steel scrap, and/or iron oxide (mill scale). That process is highly endothermic and is carried out in submerged electrode arc furnaces. The reduction requires temperatures of about 1600°–1800° C., and the boron recovery is low (typically only about 40% and thus about 2.5 times the final amount of boron must be added) due to the very high vapor pressure of $B_2O_3$ at such high reaction temperatures. Furthermore, large amounts of carbon monoxide gas are evolved during the process, necessitating extensive pollution control. Low recovery of boron and the use of extensive pollution control equipment results in a high cost of converting $B_2O_3$ (anhydrous boric acid) into ferroboron (ferroboron typically costs more than five times as much as boric acid per pound of contained boron).

Although boric acid can also be reduced by an exothermic aluminothermic process, such a process produces ferroboron with about 4% aluminum (percentages as used herein, are weight percents), which is unsuitable for use in such magnetic applications.

SUMMARY OF THE INVENTION

This is a process for producing a substantially aluminum-free iron-boron-silicon alloy (as used herein, the term "iron-boron silicon alloy" means an iron-3% boron-5%-silicon alloy which also contains up to 1.0% carbon). Anhydrous boric acid ($B_2O_3$) is reduced principally by silicon. The process comprises preparing a mixture consisting essentially of stoichiometric iron containing iron constituent, a silicon constituent, a carbon constituent, and between 1 and 1.75 times the stoichiometric boron-containing amount of anhydrous boric acid. The iron constituent is preferably selected from the group consisting of iron, iron-oxide, ferrosilicon, and mixtures thereof. The silicon constituent is preferably selected from the group consisting of silicon, ferrosilicon, and mixtures thereof. The carbon constituent is preferably selected from the group consisting of carbon, carbon in iron, (including, e.g., iron carbide) and mixtures thereof. As silicon (and possibly also some carbon) reacts with oxygen, which is in the other constituents, as well as possibly atmospheric oxygen, silicon (and possibly carbon) is added in excess of the amount that is stoichiometrically required to form the alloy. The amount of silicon added is at least about 11% by weight of the weight of the final alloy. The mixture is heated up to about 1575° C. (preferably, the $B_2O_3$ is added to a molten pool at less than 1500° C.) to produce molten iron-3% boron-5% silicon, which is covered by a silicon dioxide containing slag. Preferably, the boric acid is added last to a molten pool of the other constituents at near the minimum temperature at which the pool is molten (the pool temperature can be allowed to fall to about 1100° C. and still be molten as the final composition is approached). The iron can be melted first and the other constituents then added to the molten iron, the temperature controlled to less than 1500° C. and then the boric acid added last. The slag is removed from the top of the molten alloy and the iron-boron-silicon alloy can be either used immediately in the molten state or after solidification to eventually produce an amorphous magnetic alloy. Preferably, the constituents are iron, carbon in iron, silicon, and boric acid.

The combination of lower temperature reduction of $B_2O_3$ principally by silicon (rather than carbon) and the mixing and reduction of the boron constituent directly at essentially its concentration in the final alloy, avoids the use of expensive ferroboron and minimizes the loss of boron through volatilization of $B_2O_3$.

DESCRIPTION OF THE PREFERRED EMBODIMENTS

In this invention $B_2O_3$ (boric acid, as a dry powder preferably anhydrous technical grade) is reduced by silicon in a pool of molten iron (generally at a temperature of 1400°–1500° C.) to produce the desired iron-boron-silicon (and carbon) alloy composition. The reaction of silicon and boric acid, according to the following reaction, is exothermic, and thus little or no external heat is necessary:

$$2B_2O_3+3Si \rightarrow 4B+3SiO_2$$

The silicon dioxide forms a slag on the surface and can be easily removed. The reaction can be carried out in an electric furnace to assure that heat, if necessary, can be added to assure a good slag-metal separation.

This approach minimizes the required amount of boron and avoids the use of expensive ferroboron.

The silicon can be added either as ferrosilicon or silicon metal or mixtures thereof. The iron can be added as iron (including, for example, pig iron), iron-oxide, ferrosilicon, and mixtures thereof. It should be noted that inexpensive iron-oxide can be used to add some of the iron as the bath is highly reducing. The carbon can be added as carbon, carbon in iron (e.g. in pig iron) or as mixtures thereof. Other compounds which add constituents but do not change the final alloy could be used, but the foregoing are thought to be the most practical.

Although the reduction of boron is principally by silicon (especially at the preferred temperature of less than 1500° C. as the reaction $B_2O_3+3C \rightarrow 2B+3CO$ is thermodynamically not favored at such temperatures), it should be noted that excess carbon can also react with other oxygen in the mixture. Thus the combined amounts of silicon and carbon in the mixture are generally about 5–6% more than will be used in reactions forming carbon monoxide/dioxide and silicon dioxide with the amount of oxygen in the mixture. The amount of silicon in the mixture is to be at least about 11% of the weight of the final alloy (5% ending up in the final alloy and at least about 6% ending up in silicon oxide in the slag).

While the composition of the mixture may be calculated prior to mixing using stoichiometric iron and stoichiometric boron (up to 75%, but preferably less than 50%, excess boron may be required in a production configuration—even proportionately greater amounts may be required in experimental configurations) and adding an amount of carbon and silicon both to form carbon monoxide/dioxide and silicon dioxide with the iron of the mixture and to supply silicon and carbon in the final alloy, analyses and additions can, of course, be made to the final melt to adjust the chemistry as required. This is especially convenient as the loss of boron by volatilization of $B_2O_3$ as well as the ratio of carbon monoxide to carbon dioxide formed are quite dependent on both furnace configuration and the exact procedure utilized.

In experiments conducted according to this invention, a homogeneous alloy was obtained by quenching the melted alloy into ingots. To conclusively determine the nature of boron in this cast alloy, it was analyzed using ESCA (electron spectroscopy for chemical analysis). This analysis positively confirmed that boron was indeed present in the alloy as elemental boron and not as $B_2O_3$.

The chemical compositions of several cast ingots, determined using wet chemical analysis, are listed below in Table I. These results indicated that some boron is lost during melting, either through vaporization and/or to the silica slag, under the experimental configuration. To compensate for this loss, the amount of boron was increased in one of the starting charges (Ingot #10) to greater than stoichiometric amounts, and an alloy with composition very close to the desired composition was obtained. This relates to about 1.75 stoichiometric to give the required 3% boron. Production quantities being larger, will require less boron. The use of this greater than stoichiometric amount of boron oxide is still cheaper than using ferroboron in producing the amorphous alloy melt stock. The furnace should be designed and operated to minimize the volatilization of $B_2O_3$.

TABLE I

| Ingot | Starting B Amount | Final B (wt %) |
|---|---|---|
| Desired | — | 3.00 |
| 7 | stoichiometric | 1.53 |
| 9 | stoichiometric | 1.64 |
| 10 | 183% of stoichiometric | 3.11 |

As is known, rapid solidification is required to produce the alloy in amorphous form. This can be done either directly from the melt, or by allowing the melt to solidify for intermediate storage with remelting and rapid solidification performed at a later time.

The foregoing description of the invention is to be regarded as illustrative rather than restricting. The invention is intended to cover all processes that do not depart from the spirit and scope of the invention.

I claim:

1. A process for producing an iron, about 3% boron, about 5% silicon up to 1.0% carbon composition for a magnetic amorphous alloy, said process comprising:

a. preparing a mixture consisting essentially of an essentially stoichiometric iron-containing iron constituent, at least about 11% of alloy weight of silicon-containing silicon constituent, a carbon constituent, and between 1 and 1.75 times the stoichiometric boron-containing amount of boric acid;

b. heating said mixture to less than 1575° C. to produce molten iron, about 3% boron, about 5% silicon covered by a silicon dioxide-containing slag; and c. solidifying said molten iron-boron-silicon to produce an iron, about 3% boron, about 5% silicon alloy.

2. The process of claim 1, wherein said constituents are of iron, carbon in iron, silicon and boric acid.

3. The process of claim 1, wherein the combined amounts of silicon and carbon in said mixture are about 5–6% in excess of stoichiometric for forming carbon monoxide/dioxide and silicon dioxide with the amount of oxygen in said mixture.

4. The process of claim 1, wherein said heated mixture is monitored and at least one constituent is added, whereby the chemistry is adjusted as required.

5. The process of claim 1, wherein a pool of molten iron, silicon and carbon is formed, kept molten while being controlled to a temperature of less than 1500° C. and said boric acid is added to said molten pool.

6. A process for producing an iron, about 3% boron, about 5% silicon up to 1.0% carbon composition for a magnetic amorphous alloy, said process comprising:

a. preparing a mixture consisting essentially of an essentially stoichiometric iron-containing iron constituent, at least about 11% of alloy weight of silicon-containing silicon constituent, a carbon constituent, and between 1 and 1.75 times the stoichiometric boron-containing amount of boric acid, said iron constituent being selected from the group consisting of iron, iron oxide, ferrosilicon, and mixtures thereof, and said silicon constituent being selected from the group consisting of silicon, ferrosilicon, and mixtures thereof, and said carbon constituent being selected from the group consisting of carbon, carbon in iron and mixtures thereof;

b. heating said mixture to less than 1575° C. to produce molten iron, about 3% boron, about 5% silicon covered by a silicon dioxide-containing slag; and c. solidifying said molten iron-boron-silicon to produce an iron, about 3% boron, about 5% silicon alloy.

7. The process of claim 6, wherein said constituents are of iron, carbon in iron, silicon and boric acid.

8. The process of claim 7, wherein said heated mixture is monitored and at least one constituent is added, whereby the chemistry is adjusted as required.

9. The process of claim 8, wherein a pool of molten iron, silicon and carbon is formed, kept molten while being controlled to a temperature of less than 1500° C. and said boric acid is added to said molten pool.

* * * * *